US008584482B2

(12) United States Patent
Chae et al.

(10) Patent No.: US 8,584,482 B2
(45) Date of Patent: Nov. 19, 2013

(54) REFRIGERATOR RELATED TECHNOLOGY

(75) Inventors: Su Nam Chae, Seoul (KR); Kyeong Yun Kim, Seoul (KR); Jang Seok Lee, Seoul (KR); Min Kyu Oh, Seoul (KR); Youn Seok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 970 days.

(21) Appl. No.: 12/633,915

(22) Filed: Dec. 9, 2009

(65) Prior Publication Data

US 2010/0192609 A1 Aug. 5, 2010

(30) Foreign Application Priority Data

Jan. 30, 2009 (KR) ..... 10-2009-0007299

(51) Int. Cl.
*F25D 21/14* (2006.01)

(52) U.S. Cl.
USPC ..... 62/291; 62/419

(58) Field of Classification Search
USPC ..... 62/291, 441, 404, 407, 419, 426, 411, 62/231, 454; 312/401, 407.1, 236
See application file for complete search history.

(56) References Cited

U.S. PATENT DOCUMENTS

| | | | | |
|---|---|---|---|---|
| 5,069,273 | A | 12/1991 | O Hearne | |
| 5,321,958 | A * | 6/1994 | Kim | 62/272 |
| 5,729,996 | A * | 3/1998 | Barger | 62/288 |
| 6,070,424 | A * | 6/2000 | Bauman et al. | 62/279 |
| 6,735,976 | B2 | 5/2004 | Lee | |
| 6,997,008 | B2 | 2/2006 | Lee et al. | |
| 7,003,973 | B2 | 2/2006 | Lee et al. | |
| 7,040,118 | B2 | 5/2006 | Jung | |
| 7,114,345 | B2 | 10/2006 | Kim et al. | |
| 7,185,509 | B2 | 3/2007 | Lee et al. | |
| 7,188,490 | B2 | 3/2007 | Jeong et al. | |
| 7,322,209 | B2 | 1/2008 | Hwang et al. | |
| 7,584,627 | B2 * | 9/2009 | Sim et al. | 62/407 |
| 8,109,115 | B2 * | 2/2012 | Pippia et al. | 62/378 |
| 2004/0040335 | A1 | 3/2004 | Lee | |
| 2004/0187510 | A1 | 9/2004 | Jung | |
| 2005/0218766 | A1 | 10/2005 | Hwang | |

FOREIGN PATENT DOCUMENTS

| | | | |
|---|---|---|---|
| CN | 2276140 | Y | 3/1998 |
| CN | 1197190 | A | 10/1998 |
| CN | 2324505 | Y | 6/1999 |
| CN | 2545550 | Y | 4/2003 |
| CN | 1479065 | A | 3/2004 |
| CN | 1534261 | A | 10/2004 |
| CN | 101275802 | A | 10/2008 |
| EP | 1 394 485 | A2 | 3/2004 |
| EP | 1 462 744 | A2 | 9/2004 |
| JP | 03-225175 | A | 10/1991 |
| JP | 7-19704 | | 1/1995 |

OTHER PUBLICATIONS

PCT International Search Report and Written Opinion dated May 16, 2011 for Application No. PCT/KR2009/06857, 12 pages.
Chinese Office Action dated Nov. 12, 2012 for Appln. No. 2009-80157551 with English Translation, 22 pages.

* cited by examiner

*Primary Examiner* — Mohammad M Ali
(74) *Attorney, Agent, or Firm* — Fish & Richardson P.C.

(57) ABSTRACT

A refrigerator includes a cabinet having a plurality of storage compartments and a cold air generating compartment provided in an upper portion of the cabinet. The cold air generating compartment is in communication with the plurality of the storage compartments and houses a plurality of evaporators, with each evaporator corresponding to a particular storage compartment in the cabinet.

18 Claims, 21 Drawing Sheets

FIG. 12

1200

| 1210 Current Fan Configuration | | 1220 Temperature | | 1230 Door Position | | 1240 Door Open Duration | | 1250 Number of Door Openings | | 1260 Time In Single | 1270 Set Fan Configuration | |
|---|---|---|---|---|---|---|---|---|---|---|---|---|
| Freezer | Fridge | Freezer | Fridge | Freezer | Fridge | Freezer | Fridge | Freezer | Fridge | Config. | Freezer | Fridge |
| On | On | In Range | In Range | Closed | Closed | N/A | N/A | N/A | N/A | N/A | On | On |
| On | On | < Range | In Range | Closed | Closed | N/A | N/A | N/A | N/A | N/A | Off | On |
| On | On | In Range | < Range | Closed | Closed | N/A | N/A | N/A | N/A | N/A | On | Off |
| On | On | > Range | In Range | Closed | Closed | N/A | N/A | N/A | N/A | N/A | On | Off |
| On | On | In Range | > Range | Closed | Closed | N/A | N/A | N/A | N/A | N/A | Off | On |
| On | On | > Range | > Range | Closed | Closed | N/A | N/A | N/A | N/A | N/A | On | On |
| On | On | < Range | < Range | Closed | Closed | N/A | N/A | N/A | N/A | N/A | Off | Off |
| On | Off | > Range | In Range | Open | Closed | < Limit | N/A | < Limit | N/A | < Limit | On | Off |
| On | Off | > Range | In Range | Open | Closed | > Limit | N/A | < Limit | N/A | < Limit | Off | On |
| On | Off | > Range | In Range | Open | Closed | < Limit | N/A | > Limit | N/A | < Limit | Off | On |
| On | Off | > Range | In Range | Closed | Closed | N/A | N/A | N/A | N/A | > Limit | On | On |
| Off | On | In Range | > Range | Closed | Open | N/A | > Limit | N/A | > Limit | < Limit | On | Off |
| Off | On | < Range | > Range | Closed | Open | N/A | > Limit | N/A | > Limit | < Limit | Off | Off |
| On | On | In Range | In Range | Closed | Open | N/A | > Limit | N/A | < Limit | N/A | On | Off |
| On | On | > Range | > Range | Open | Open | < Limit | > Limit | < Limit | < Limit | N/A | On | Off |

REFRIGERATOR RELATED TECHNOLOGY

CROSS REFERENCE TO RELATED APPLICATION

This application claims the benefit of the Patent Korean Application No. 10-2009-0007299, filed on Jan. 30, 2009, which is hereby incorporated by reference as if fully set forth herein.

FIELD

The present disclosure relates to refrigerator technology.

BACKGROUND

Refrigerators are home appliances that are able to freeze or preserve fresh foods, such as meats, fruits, beverages, and the like, in predetermined storage compartments, using a four-step-cycle of compressing, condensing, expanding and evaporating refrigerant. Such a refrigerator may have a cabinet including a storage compartment, a door coupled to the cabinet to open and close the storage compartment, a cold air generating compartment accommodating an evaporator to generate cold air, and a machine compartment accommodating components, such as a compressor and a condenser and the like.

According to some configurations of a refrigerator, the cold air generating compartment is provided in a rear of the storage compartment. For example, a refrigerating compartment or freezing compartment and the cold air generating compartment are partitioned by a partition wall. The machine compartment is provided in a rear portion under the storage compartment.

SUMMARY OF THE DISCLOSURE

In one aspect, a refrigerator includes a cabinet, a first storage compartment defined by the cabinet at a first portion of the cabinet and a second storage compartment defined by the cabinet at a second portion of the cabinet that is different than the first portion of the cabinet. The refrigerator also includes a cold air generating compartment provided in an uppermost portion of the cabinet and connected with the first and second storage compartments. The uppermost portion of the cabinet is positioned above the first and second storage compartments when the refrigerator is oriented in an ordinary operating orientation. The refrigerator further includes a partition structure positioned in the cold air generating compartment. The partition structure divides the cold air generating compartment into a first portion that is connected with the first storage compartment and a second portion that is connected with the second storage compartment. In addition, the refrigerator includes a first evaporator positioned in the first portion of the cold air generating compartment and configured to generate cool air supplied to the first storage compartment and a second evaporator positioned in the second portion of the cold air generating compartment and configured to generate cool air supplied to the second storage compartment.

Implementations may include one or more of the following features. For example, the refrigerator may include a first cold air outlet provided between the cold air generating compartment and the first storage compartment and configured to guide cold air generated by the first evaporator in the first portion of the cold air generating compartment into the first storage compartment. The refrigerator also may include a second cold air outlet provided between the cold air generating compartment and the second storage compartment and configured to guide cold air generated by the second evaporator in the second portion of the cold air generating compartment into the second storage compartment.

In some examples, the first and second storage compartments may include a freezing compartment and a refrigerating compartment. In these examples, the refrigerator may include a first cold air fan positioned adjacent to the first cold air outlet and configured to promote movement of cold air through the first cold air outlet and a second cold air fan positioned adjacent to the second cold air outlet and configured to promote movement of cold air through the second cold air outlet. The first and second cold air fans may include a cross-flow fan.

In addition, the refrigerator may include a partition wall partitioning an inner space of the cabinet into the freezing compartment and the refrigerating compartment. The first cold air outlet may be provided adjacent to the partition structure and the first cold air fan may be arranged in the first cold air outlet such that cold air discharged from the first cold air outlet moves vertically along the partition wall.

The first portion of the cold air generating compartment may include a first cold air generating compartment in communication with the freezing compartment, the second portion of the cold air generating compartment may include a second cold air generating compartment in communication with the refrigerating compartment, the first evaporator may be positioned in the first cold air generating compartment, and the second evaporator may be positioned in the second cold air generating compartment. The refrigerator also may include a first return duct connecting the freezing compartment with the first cold air generating compartment. The first return duct may guide air of the freezing compartment into the first cold air generating compartment. The refrigerator further may include a second return duct connecting the refrigerating compartment with the second cold air generating compartment. The second return duct may guide air of the refrigerating compartment into the second cold air generating compartment. The first return duct may be arranged along a side wall and an upper wall of the freezing compartment and the second return duct may be arranged along a side wall and an upper wall of the refrigerating compartment. The freezing compartment may be positioned in parallel with the refrigerating compartment and the cold air generating compartment may be installed over both the freezing and refrigerating compartments.

In some examples, the refrigerator may include a first water collecting tray provided under the first evaporator inside the first portion of the cold air generating compartment. The first water collecting tray may be configured to collect defrost water generated by the first evaporator. In these examples, the refrigerator may include a second water collecting tray provided under the second evaporator inside the second portion of the cold air generating compartment. The second water collecting tray may be configured to collect defrost water generated by the second evaporator.

In some implementations, the refrigerator may include a machine compartment provided in the uppermost portion of the cabinet, on a first side of the cold air generating compartment. In these implementations, the refrigerator may include a storage device provided in the uppermost portion of the cabinet, on a second side of the cold air generating compartment opposite of the first side. The storage device may have an access opening that is configured to enable placement of items in and removal of items from the storage device and the refrigerator may include at least one door configured to open and close the access opening of the storage device.

In another aspect, a refrigerator includes a cabinet, a freezing compartment defined by the cabinet at a first portion of the cabinet, and a refrigerating compartment defined by the cabinet at a second portion of the cabinet that is different than the first portion of the cabinet. The refrigerator also includes a cold air generating compartment provided in an upper portion of the cabinet and connected with the freezing and refrigerating compartments. The upper portion of the cabinet is positioned above the freezing and refrigerating compartments when the refrigerator is oriented in an ordinary operating orientation. The refrigerator further includes a partition structure positioned in the cold air generating compartment. The partition structure divides the cold air generating compartment into a first portion that is connected with the freezing compartment and a second portion that is connected with the refrigerating compartment. In addition, the refrigerator includes a first evaporator positioned in the first portion of the cold air generating compartment and configured to generate cool air supplied to the freezing compartment and a second evaporator positioned in the second portion of the cold air generating compartment and configured to generate cool air supplied to the refrigerating compartment. Further, the refrigerator includes a first fan configured to promote movement of cold air from the first portion of the cold air generating compartment to the freezing compartment and a second fan configured to promote movement of cold air from the second portion of the cold air generating compartment to the refrigerating compartment.

Implementations may include one or more of the following features. For example, the refrigerator may include a first cold air outlet that enables communication of air in the first portion of the cold air generating compartment with the freezing compartment and a second cold air outlet that enables communication of air in the second portion of the cold air generating compartment with the refrigerating compartment. The partition structure may be positioned between the first cold air outlet and the second cold air outlet.

The first fan may be positioned adjacent to the first cold air outlet and configured to promote movement of cold air of the first portion of the cold air generating compartment through the first cold air outlet and into the freezing compartment. The second fan may be positioned adjacent to the second cold air outlet and configured to promote movement of cold air of the second portion of the cold air generating compartment through the second cold air outlet and into the refrigerating compartment.

In addition, the refrigerator may include a first return duct configured to guide cold air of the freezing compartment into the first portion of the cold air generating compartment and a second return duct configured to guide cold air of the refrigerating compartment into the second portion of the cold air generating compartment. The refrigerator may include a plurality of machine compartments provided on both sides of the cold air generating compartment. A condenser may be installed in one of the machine compartments provided on a side of the cold air generating compartment and a compressor may be installed in the other one of the machine compartments provided on the other side of the cold air generating compartment.

In some examples, the refrigerator may include a machine compartment provided on a side of the cold air generating compartment. The machine compartment may accommodate a condenser and a compressor and may be positioned above only the refrigerating compartment when the refrigerator is oriented in an ordinary operating orientation. In these examples, the refrigerator may include a storage device provided on the other side of the cold air generating compartment. The storage device may have an access opening that is configured to enable placement of items in and removal of items from the storage device and the refrigerator may include at least one door configured to open and close the access opening of the storage device.

BRIEF DESCRIPTION OF THE DRAWINGS

FIG. 12 is a table illustrating example logic for the example control method shown in FIG. 11;

DETAILED DESCRIPTION

Techniques are described for arranging a machine room of a refrigerator at an uppermost part of a refrigerator body. By arranging the machine room at an uppermost part of the refrigerator body, a size of a refrigerating compartment and/or a freezing compartment may be increased because usable space of the refrigerating compartment and/or the freezing compartment is not taken up by the machine room and its components. For example, the machine room may be positioned at a relatively high location that is outside of a typical user's reach. In this example, because the machine is positioned outside of a typical user's reach and at a position that is not suitable for a refrigerating compartment and/or freezing compartment, the machine room does not take up space that is otherwise usable for the refrigerating compartment and/or the freezing compartment.

In some implementations, the machine room is vertically-partitioned into multiple cabinets or compartments across an uppermost part of a refrigerator body. In these implementations, when the refrigerator is a side-by-side type having a freezing compartment and a refrigerating compartment arranged side-by-side, a central cool air generation compartment may be part of the machine room and configured to distribute cool air to the freezing compartment and the refrigerating compartment (e.g., both sides of the refrigerator). In addition, when the refrigerator is the side-by-side type, heat producing components of the machine room (e.g., compressor) may be housed in a vertically-partitioned compartment that is positioned over the refrigerating compartment instead of the freezing compartment. Arranging the heat producing components of the machine room over only the refrigerating compartment (or having a majority of an area taken up by the heat producing components of the machine room being positioned over the refrigerating compartment rather than the freezing compartment) may lead to improved efficiency in cooling the refrigerator and energy savings. Moreover, a negative impact caused by an overheating failure of one or more of the heat producing components may be reduced when the failing component is positioned over the refrigerating compartment instead of freezing compartment because the additional heat generated by the failing component is less likely to spoil food in the refrigerating compartment.

In some examples, components of the machine room may not require the machine room to occupy an entirety of an uppermost portion of a refrigerator body. In these examples, the additional space of the uppermost portion of the refrigerator body that is not taken up by the machine room may be used to provide additional functionality. For instance, the additional space may be used as an additional storage compartment that is not cooled by the refrigerator or the additional space may be used as additional space for a refrigerating and/or freezing compartment of the refrigerator.

Figure 1:
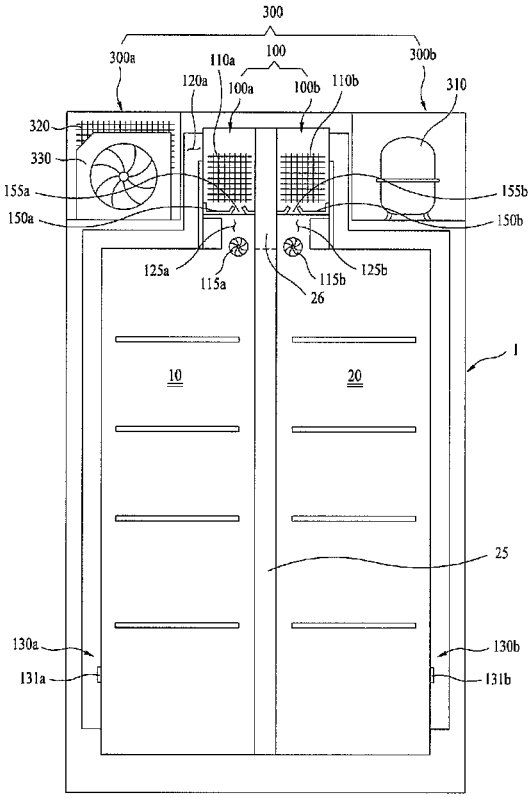
FIG. 1 is a front view illustrating a refrigerator.

FIG. 1 illustrates an example of a refrigerator that is oriented in an ordinary operating orientation. As shown in FIG. 1, a refrigerator includes a cabinet 1 having at least one storage compartment. As shown, the refrigerator includes a freezing compartment 10, a refrigerating compartment 20, and a cold air generating compartment 100 provided in an upper portion of the cabinet 1. The cold air generating compartment 100 is configured to supply cold air to each of the freezing compartment 10 and the refrigerating compartment 20.

In some examples, the freezing compartment 10 and the refrigerating compartment 20 are partitioned by a partition wall 25 and arranged side-by-side in parallel. In other examples, the freezing compartment 10 and the refrigerating compartment 20 have other orientations, such as a stacked configuration with an upper freezing compartment 10 and a lower refrigerating compartment 20 or a lower freezing compartment 10 and an upper refrigerating compartment 20.

The cold air generating compartment 100 is partitioned into a first cold air generating compartment 100*a* and a second cold air generating compartment 100*b*. The first cold air generating compartment 100*a* generates cold air supplied to the freezing compartment 10 and the second cold air generating compartment 100*b* generates cold air supplied to the refrigerating compartment 20.

The first cold air generating compartment 100*a* is in communication with the freezing compartment 10 and the second cold air generating compartment 100*b* is in communication with the refrigerating compartment 20. The first cold air generating compartment 100*a* and the second cold air generating compartment 100*b* are partitioned by a partition structure 26.

The partition structure 26 may be positioned on the partition wall 25 that partitions the storage compartment into the freezing compartment 10 and the refrigerating compartment 20. The partition structure 26 also may be part of the partition wall 25.

A machine compartment 300 is positioned adjacent to the cold air generating compartment 100. The machine compartment 300 accommodates a compressor 310, a condenser 320, and a condensation fan 330. The machine compartment 300 has a first machine compartment 300*a* placed next to the first cold air generating compartment 100*a* and a second machine compartment 300*b* placed next to the second cold air generating compartment 100*b*. The first machine compartment 300*a* accommodates the condenser 320 and the condensation fan 330. The second machine compartment 300*b* accommodates the compressor 310.

Alternatively, the first and second machine compartments 300*a* and 300*b* may be provided inside the cold air generating compartment 100, rather than partitioned from the machine compartment 300. A single machine compartment 300 may accommodate the compressor 310, the condenser 320, and the condensation fan 330.

As to an exterior appearance of the refrigerator, the height of the cold air generating compartment 100 may be identical to that of the machine compartment 300.

A first evaporator 110*a* and a second evaporator 110*b* are positioned within the first and second cold air generating compartments 100*a* and 100*b*, respectively. The first evaporator 110*a* generates cold air in the first cold air generating compartment 100*a* and the second evaporator 110*b* generates cold air in the second cold air generating compartment 100*b*. Cold air outlets 125*a* and 125*b* are defined between the first cold air generating compartment 100*a* and the freezing compartment 10 and between the second cold air generating compartment 100*b* and the refrigerating compartment 20, respectively. The cold air outlets 125*a* and 125*b* guide the cold air generated by the evaporators 110*a* and 110*b* toward the freezing and refrigerating compartments 10 and 20, respectively.

A first cold air outlet 125*a* connects the freezing compartment 10 with the first cold air generating compartment 100*a* and a second cold air outlet 125*b* connects the refrigerating compartment 20 with the second cold air generating compartment 100*b*.

Water collecting trays 150*a* and 150*b* may be provided between the cold air outlets 125*a* and 125*b* and the evaporators 110*a* and 110*b* to receive defrost water generated by the evaporators 110*a* and 110*b* during defrosting operation.

A cold air guiding recess 155*a* and 155*b* may be defined in each of the water collecting trays 150*a* and 150*b*, respectively. The cold air guiding recesses 155*a* and 155*b* guide cold air of the evaporators 110*a* and 110*b* toward the cold air outlets 125*a* and 125*b*, respectively.

A first water collecting tray 150*a* is installed below the first evaporator 110*a* and a second water collecting tray 150*b* is installed below the second evaporator 110*b*.

A cold air fan is positioned in each of the first and second cold air outlets 125*a* and 125*b*. The cold air fan promotes movement of cold air generated by the evaporators 110*a* and 110*b* into the freezing and refrigerating compartments 10 and 20, respectively. A first cold air fan 115*a* corresponds to the first cold air outlet 125*a* and a second cold air fan 115*b* corresponds to the second cold air outlet 125*b* . The cold air fans 115*a* and 115*b* may include a cross-flow fan.

Cold air inlets 120*a* and 120*b* may be defined in sides of the cold air generating compartment 100. The cold air inlets 120*a* and 120*b* draw cold air having passed through the freezing and refrigerating compartments 10 and 20 into the cold air generating compartment 100.

The cold air inlets 120*a* and 120*b* are each connected with a guiding duct 130*a* and 130*b* that guides the flow of the cold air inside the freezing and refrigerating compartments 10 and 20. The guiding ducts 130*a* and 130*b* include a first guiding duct 130*a* connecting the freezing compartment 10 with the first cold air generating compartment 100*a* and a second guiding duct 130*b* connecting the refrigerating compartment 20 with the second cold air generating compartment 100*b*.

The first and second guiding ducts 130*a* and 130*b* are arranged along side and upper walls of the freezing and refrigerating compartments 10 and 20 and side walls of the first and second cold air generating compartments 100*a* and 100*b*.

The cold air inlets 120*a* and 120*b* include a first cold air inlet 120*a* that draws cold air of the freezing compartment 10 and a second cold air inlet 120*b* that draws cold air of the refrigerating compartment 20.

The first and second cold air fans 115*a* and 115*b* are positioned directly under the first and second cold air guiding recesses 155*a* and 155*b*, respectively, and in centers of the first and second cold air outlets 125*a* and 125*b*, respectively.

When the first and second cold air fans 115*a* and 115*b* rotate, the cold air generated by the first and second evaporators 110*a* and 110*b* is drawn by the first and second cold air fans 115*a* and 115*b* toward the freezing compartment 10 and refrigerating compartment 20, respectively. The cold air moves vertically downward into the freezing compartment 10 and refrigerating compartment 20 after passing the first and second cold air fans 115*a* and 115*b*, respectively.

Because the first and second cold air fans 115*a* and 115*b* rotate, some of the cold air moves vertically downward along the partition wall and the other flows along a rotation direction such that the cold air may be supplied to the freezing and refrigerating compartments 10 and 20 uniformly.

Figure 2:
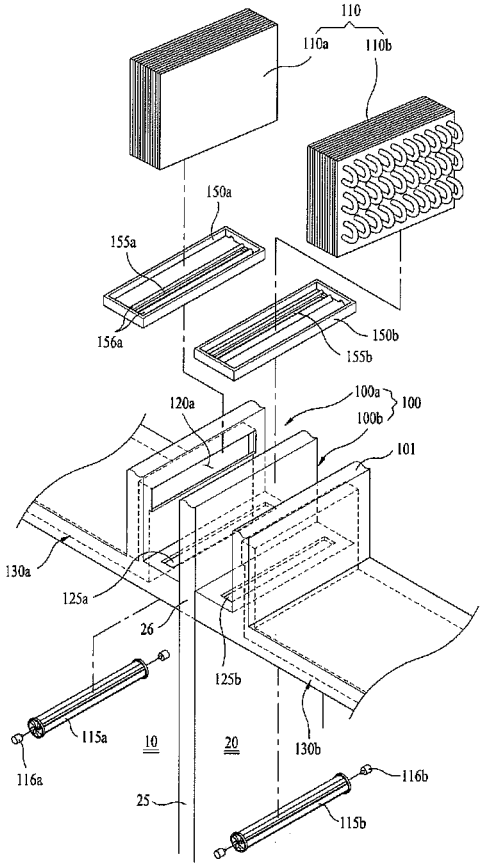
FIG. 2 is an exploded perspective view illustrating a cold air generating compartment of the refrigerator.

As shown in FIG. 2, the first and second cold air generating compartment 100*a* and 100*b* are defined by the partition structure 26 provided in a center portion of the cold air generating compartment 100.

The first and second cold air outlets 135*a* and 135*b* are defined in bottoms of the first and second cold air generating compartments 100*a* and 100*b*, respectively, such that the freezing compartment 10 may be in communication with the refrigerating compartment 20.

The first and second cold air fans 115*a* and 115*b* are provided in the first and second cold air outlets 125*a* and 125*b*, respectively, as mentioned above.

Driving members 116*a* and 116*b* are provided in the first and second cold air fans 115*a* and 115*b*, respectively, to drive the fans. The driving members 116*a* and 116*b* may be motors.

The first cold air generating compartment 100*a* may be positioned on (e.g., above) the freezing compartment 10 and the second cold air generating compartment 100*b* may be positioned on (e.g., above) the refrigerating compartment 20 to supply the cold air of the cold air generating compartment 100 to the freezing and refrigerating compartments 10 and 20 uniformly.

The first and second water collecting trays are provided between the first and second cold air outlets 125*a* and 125*b* and the first and second evaporators 110*a* and 110*b*, respectively. The first and second cold air guiding recesses defined in the first and second water collecting trays 150*a* and 150*b* may be positioned directly above the first and second cold air outlets 125*a* and 125*b*.

In some examples, each circumference of the first and second cold air guiding recesses 155*a* and 155*b* is surrounded by projecting ribs 156*a* and 156*b* to reduce the possibility of defrost water collected in the water collecting trays 150*a* and 150*b* from leaking into the first and second cold air guiding recesses 155*a* and 155*b*.

The first and second evaporators 110*a* and 110*b* provided on the first and second water collecting trays 150*a* and 150*b* may be have an approximately hexagonal shape.

The first and second cold air inlets 120*a* are positioned next to the first and second evaporators 110*a* and 110*b*, respectively.

The first and second cold air generating compartments 100*a* and 100*b* are defined as an airtight space by insulation walls 101. The inlets and outlets are defined through the insulation walls 101 to enable communication between the cold air generating compartment 100 and the freezing and refrigerating compartments 10 and 20.

The first and second guiding ducts 130*a* and 130*b* are positioned in both sides of the insulation walls 101 that define the first and second cold air generating compartments 100*a* and 100*b*. The first and second cold air inlets 120*a* and 120*b* are defined at the end of the first and second guiding ducts 130*a* and 130*b*, respectively.

Figure 3:
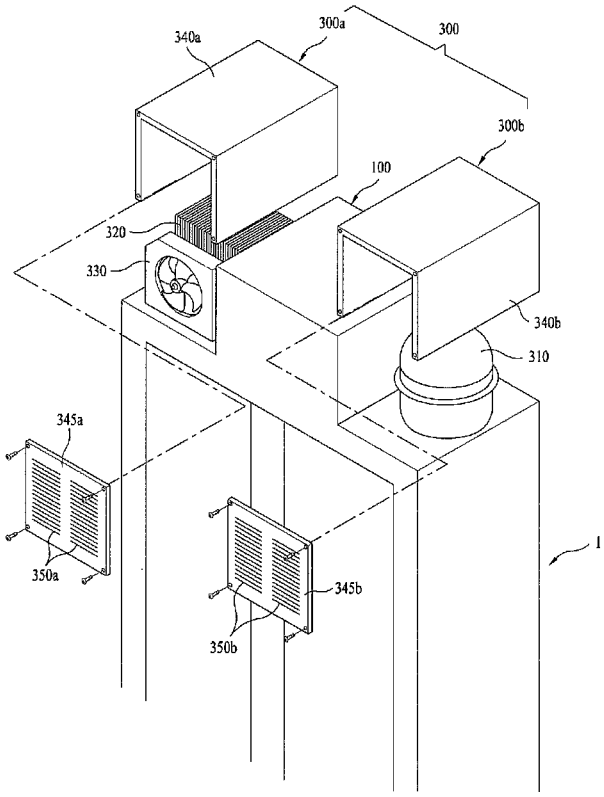
FIG. 3 is an exploded perspective view illustrating a machine compartment of the refrigerator.

As shown in FIG. 3, the first and second machine compartments 300*a* and 300*b* are positioned on both sides of the cold air generating compartment 100. The condenser 320 and the condensation fan 330 are provided in the first machine compartment 300*a* and the compressor 310 is provided in the second machine compartment 300*b*.

The first and second machine compartments 300*a* and 300*b* are defined by first and second housings 340*a* and 340*b*, respectively. First and second cover members 345*a* and 345*b* are installed to fronts of the first and second housings 340*a* and 340*b*, respectively, to reduce exposure of the insides of the machine compartments 300*a* and 300*b* to the outside.

A plurality of communication holes 350*a* and 350*b* may be provided in the first and second cover members 345*a* and 345*b*, respectively, to communicate internal air of the machine compartment 300 with external air.

Figure 4:
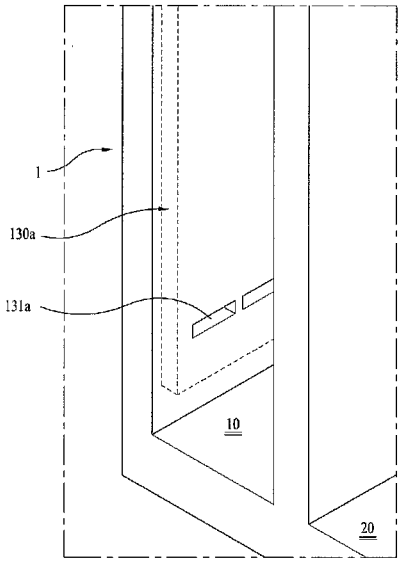
FIG. 4 is a perspective view illustrating a guide duct installed in the refrigerator.

As shown in FIG. 4, the first guiding duct 130*a* is provided in the portion of the freezing compartment 10 and a first guiding hole 131*a* is defined at (e.g., in) an end portion of the first guiding duct 130*a* to draw air from inside the freezing compartment 10 into the first guiding duct 130*a*.

As a result, the air of the freezing compartment 10 drawn via the first guiding hole 131*a* flows along the first guiding duct 130*a* into the first cold air generating compartment (100*a*, see FIG. 1). Then, the air is re-supplied to the freezing compartment 10 by the first cold air fan 115*a*, after passing the first evaporator 110*a* (see FIG. 1).

This configuration and air circulation may be applicable to those of the refrigerating compartment 20, and the second guiding duct 130*b*, and the second guiding hole 131*b* (see FIG. 1).

Figure 5:
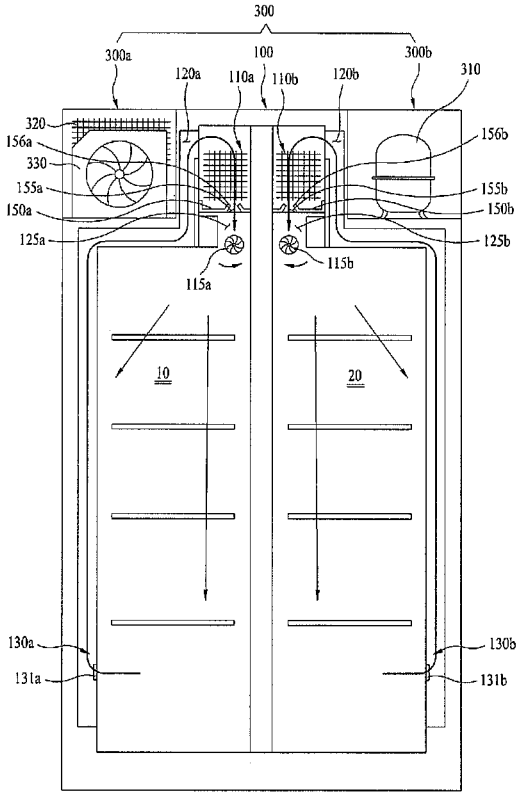
FIG. 5 is a front view illustrating cold air supplied to a freezing compartment and a refrigerating compartment provided in the refrigerator.

Examples of operation of the refrigerator are described below with respect to FIGS. 5-7. As shown in FIG. 5, once the compressor 310 operates, the refrigerant compressed by the compressor 310 flows into the condenser 320 in a state of the cold air being supplied to both of the freezing and refrigerating compartments 10 and 20.

The refrigerant inside the condenser 320 is condensed through cooling operation performed by the condensation fan 330. Then, the condensed refrigerant is decompressed and expanded through a predetermined expansion process, which results in low temperature and low pressure refrigerant. The low-temperature-and-low-pressure air is drawn into the evaporators 110*a* and 110*b*.

Next, the first and second cold air fans 115*a* and 115*b* rotate, and the cold air that has passed over the evaporators 110*a* and 110*b* is supplied to the freezing and refrigerating compartments 10 and 20.

Such rotation causes at least some of the cold air to move vertically downward along the partition wall 25. The cold air moved vertically downward along the partition wall 25 is employed as an 'air curtain' and some of the cold air is supplied to the freezing and refrigerating compartments 10 and 20 uniformly.

The cold air supplied to the freezing and refrigerating compartments 10 and 20 moves to the lower portions of the freezing and refrigerating compartments 10 and 20 and the cold air is re-supplied to the first and second cold air generating compartments 100*a* and 100*b* after being drawn into the first and second guiding ducts 130*a* and 130*b*.

Because the first and second cold air fans 115*a* and 115*b* are rotating continuously, the first and second cold air generating compartments 100*a* and 100*b* are at a low pressure in comparison to the lower portion of the freezing or refrigerating compartment 10 or 20 and thus the air in the lower portion of the freezing or refrigerating compartment 10 or 20 moves into the first and second cold air generating compartments 100*a* and 100*b* along the first and the second guiding duct 130*a* and 130*b*.

If the temperature of the freezing and refrigerating compartments 10 and 20 is in a predetermined range, the first and second cold air fans 115*a* and 115*b* are controlled to stop operating and the positive supply of the cold air stops temporarily.

Figure 6:
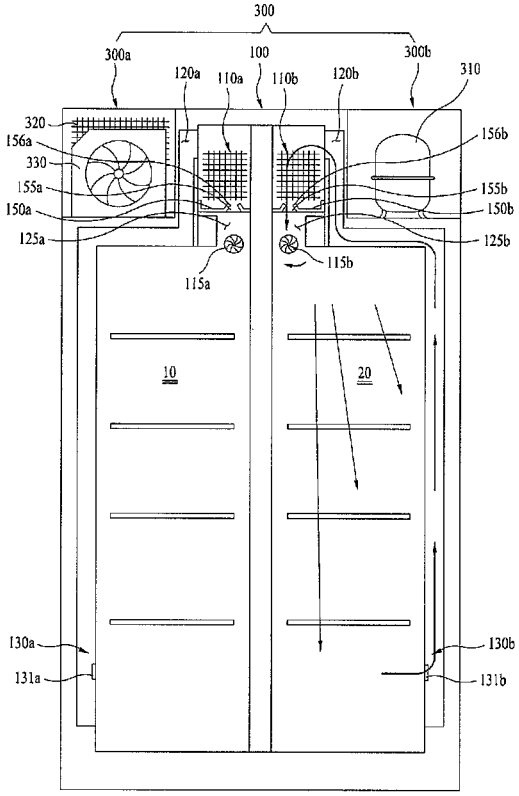
FIG. 6 is a front view illustrating cold air supplied to the refrigerating compartment.

Then, if the temperature of the freezing compartment 10 is in the normal range and the temperature of the refrigerating compartment 20 increases abnormally because of external air drawn therein by the opening of the door, the second cold air fan 115*b* starts to operate as shown in FIG. 6.

As the cold air that has passed over the second evaporator 110*b* is supplied to the refrigerating compartment 20, the temperature inside the refrigerating compartment 20 decreases relatively quickly and returns the temperature to a normal range.

Because the freezing compartment 10 is partitioned from the refrigerating compartment 20 and the first cold air generating compartment 100*a* is partitioned from the second cold air generating compartment 100*b*, the cold air inside the freezing compartment 10 may not be mixed with the cold air inside the refrigerating compartment 20. As a result, smells inside the freezing compartment may not be mixed with smells inside the refrigerating compartment 20.

Figure 7:
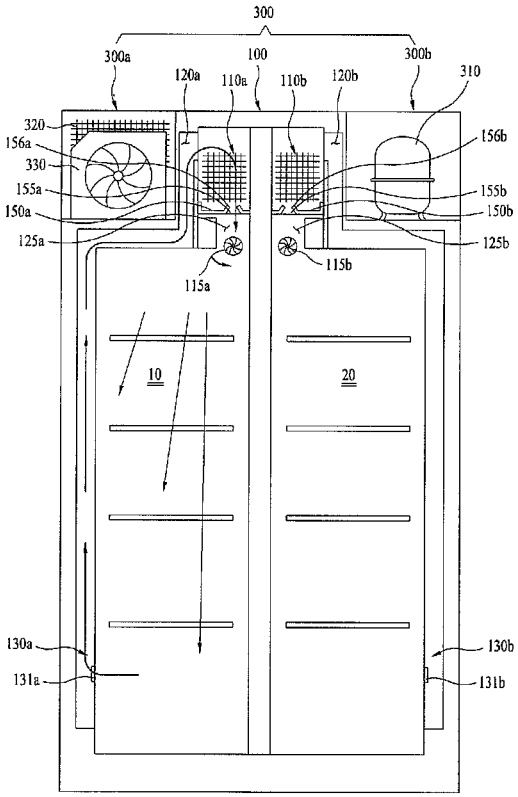
FIG. 7 is a front view illustrating cold air supplied to the freezing compartment.

FIG. 7 illustrates an opposite case to the case of FIG. 6. Specifically, the first cold air fan 115*a* stops to operate and the temperature inside the freezing and refrigerating compartments 10 and 20 is in the normal range. At this time, if a storing object having a relatively high temperature is stored in the freezing compartment 10, the temperature inside the freezing compartment 10 may increase drastically out of a predetermined range.

In this example, the refrigerator may be controlled to perform the intensive supply of cold air to the freezing compartment 10.

The first cold air fan 115*a* starts to operate and the cold air that has passed over the evaporator 115*a* is supplied to the freezing compartment 10 at a higher volume or intensity. The supply of cold air to the freezing compartment 10 at a higher volume or intensity causes a decrease in the temperature inside the freezing compartment such that the temperature inside the freezing compartment 10 may return to the normal range.

Figure 8:
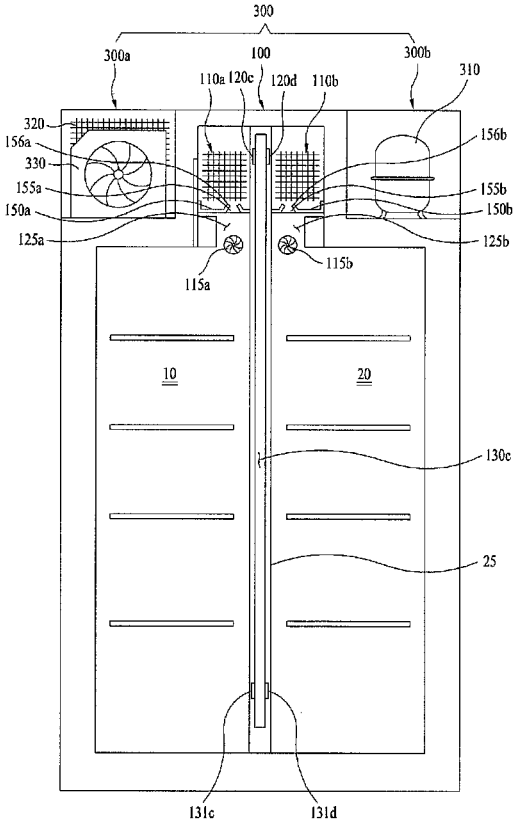
FIG. 8 is a front view illustrating an example refrigerator.

FIG. 8 illustrates another example of a refrigerator. As shown, instead of having separate guiding ducts 130*a* and 130*b* for the freezing and refrigerating compartments 10 and 20, respectively, the refrigerator has a shared guiding duct 130*c* that guides are from each of the freezing and refrigerating compartments 10 and 20 to the cold air generating compartments 100*a* and 100*b*. The shared guiding duct 130*c* is positioned within the barrier 25 between the freezing and refrigerating compartments 10 and 20. The shared guiding duct 130*c* includes a freezing compartment guiding hole 131*c* and a refrigerating compartment guiding hole 131*d*. The freezing compartment guiding hole 131*c* allows air from the freezing compartment to enter the shared guiding duct 130*c* and the refrigerating compartment guiding hole 131*d* allows air from the refrigerating compartment 20 to enter the shared guiding duct 130*c*.

A first cold air inlet 120*c* is defined in a side wall of the cold air generating compartment 100*a*. The first cold air inlet 120*c* draws cold air into the cold air generating compartment 100*a*. The first cold air inlet 120*c* is connected with the guiding duct 130*c*. A second cold air inlet 120*d* is defined in a side wall of the cold air generating compartment 100*b*. The second cold air inlet 120*d* draws cold air into the cold air generating compartment 100*b*. The second cold air inlet 120*d* is connected with the guiding duct 130*c*.

Figure 9:
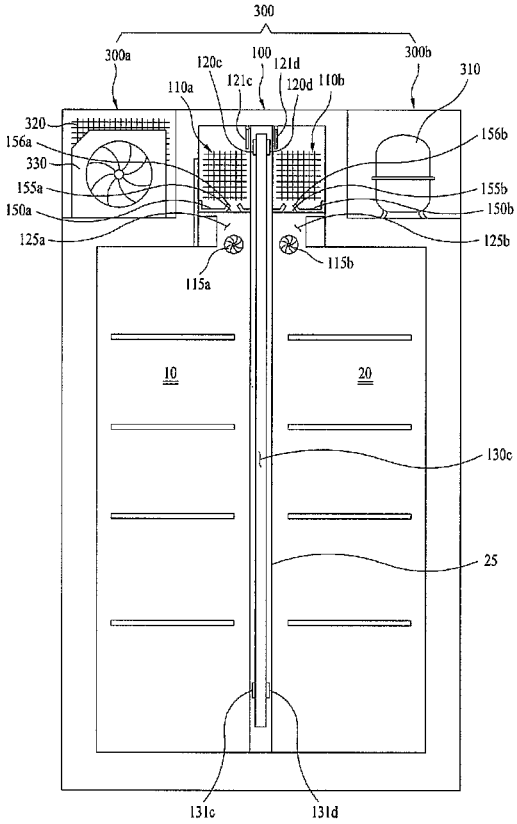
FIG. 9 is a front view illustrating an example refrigerator.

FIG. 9 illustrates another example of a refrigerator having a shared guiding duct 130*c*. As shown, the refrigerator includes a first damper 121*c* positioned at the first cold air inlet 120*c* and a second damper 121*d* positioned at the second cold air inlet 120*d*. The first damper 121*c* is configured to open and close the first cold air inlet 120*c* to selectively stop cold air moving into the cold air generating compartment 100*a*. The second damper 121*d* is configured to open and close the second cold air inlet 120*d* to selectively stop cold air moving into the cold air generating compartment 100*b*.

Figure 10:
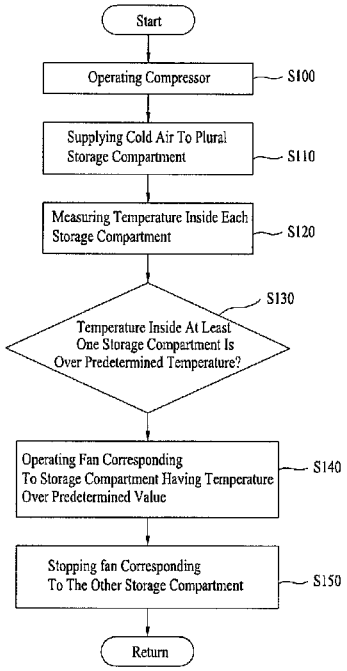
FIG. 10 is a flow chart illustrating an example control method of a refrigerator.

FIG. 10 illustrates an example control method of the above-described refrigerators. First, the compressor operates (S100) and cold air is supplied to the plurality of storage compartments, specifically, the freezing and refrigerating compartments (S110).

After the temperature inside each of the storage compartments is measured (S120), it is determined whether the temperature inside at least one storage compartment is over a predetermined temperature (S130).

The fan corresponding to the storage compartment having the temperature over the predetermined value is operated or maintained in an operating state (S140) according to the result of the determination.

To supply the cold air at a higher volume or intensity to the storage compartment having the abnormal temperature, the fan corresponding to the other storage compartment is stopped or turned off (S150).

If the temperature inside the storage compartment having the abnormal temperature distribution returns to a normal value, the refrigerator re-operates normally.

Figure 11:
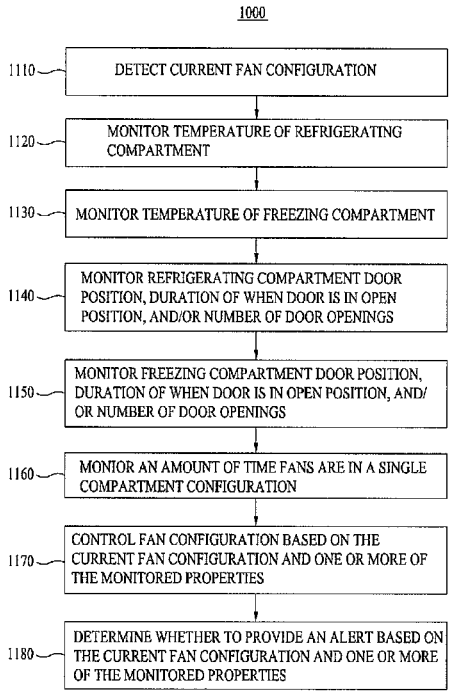
FIG. 11 is a flow chart illustrating an example control method of a refrigerator.

FIG. 11 illustrates another example process 1100 of controlling a refrigerator. The process 1100 accounts for temperature, door orientation measurements, and fan configuration measurements in controlling a fan configuration of a refrigerator. The process 1100 may be performed by a control unit (e.g., processor, computer, etc.) of a refrigerator.

The control unit detects a current fan configuration (1110). For example, the control unit detects whether a freezing compartment fan (e.g., fan 115*a*) that controls air flow to the freezing compartment is on or off and whether a refrigerating compartment fan (e.g., fan 115*b*) that controls air flow to the refrigerating compartment is on or off. The control unit may detect the current fan configuration by accessing data from one or more sensors configured to sense whether the freezing compartment fan is on or off and whether the refrigerating compartment fan is on or off. The control unit may detect the current fan configuration by accessing stored data (e.g., one or more settings, one or more state variables, etc.) that indicates whether the freezing compartment fan has been controlled to be in an on or off state and whether the refrigerating compartment fan has been controlled to be in an on or off state.

The control unit monitors temperature of the refrigerating compartment (1120). For instance, the control unit accesses a temperature measurement from a temperature sensor configured to measure a temperature of the refrigerating compartment and compares the accessed temperature measurement to a range of one or more acceptable temperature measurements. Based on the comparison, the control unit determines whether the temperature measurement is within the range of one or more acceptable temperature measurements, below the range of one or more acceptable temperature measurements, or above the range of one or more acceptable temperature measurements. The control unit may periodically or continuously monitor a temperature of the refrigerating compartment.

The control unit monitors temperature of the freezing compartment (1130). For instance, the control unit monitors temperature of the freezing compartment using techniques similar to those described above with respect to reference numeral 1120.

The control unit monitors a refrigerating compartment door position, a duration of when the refrigerating compartment door is oriented in an opened position, and/or a number of times the refrigerating compartment door has been opened in a given time period (1140). For instance, the control unit monitors a refrigerating compartment door position by accessing data from one or more sensors configured to sense whether the refrigerating compartment door is oriented in an opened position or a closed position. Based on the sensor data, the control unit determines whether the refrigerating compartment door is oriented in an opened position or a closed position. The control unit may periodically or continuously monitor a position of the refrigerating compartment door.

The control unit also monitors duration of when the refrigerating compartment door is oriented in an opened position. For example, when the control unit first detects that the refrigerating compartment door has moved from a closed position to an opened position, the control unit may start a timer to measure a time that refrigerating compartment door remains opened or the control unit may log the time when the control unit detected that the refrigerating compartment door moved from a closed position to an opened position. When the control unit uses a timer to measure an open time of the refrigerating compartment door, the control unit periodically or continuously checks the timer to determine whether the refrigerating compartment door has been oriented in an opened position more than a threshold amount of time. When the control unit logs an opened time of the refrigerating compartment door, the control unit periodically or continuously compares the opened time to a current time to determine whether the refrigerating compartment door has been oriented in an opened position more than a threshold amount of time. When the control unit detects that the refrigerating compartment door has moved back to a closed position, the control unit ends monitoring of the door open duration, resets the monitoring data, and awaits another detection of the refrigerating compartment door moving from a closed position to an opened position.

The control unit further monitors a number of times the refrigerating compartment door has been opened in a given time period. For example, each time the control unit detects that the refrigerating compartment door has moved from a closed position to an opened position, the control unit updates data to track the door opening (e.g., increments a counter). The control unit may only consider detected door openings within a given past period of time (e.g., door openings in the last half hour or ten minutes) in determining the number. As time passes, the control unit reduces the number of detected door openings (e.g., decrements or resets a counter). The control unit periodically or continuously compares the number of door openings to a threshold number to determine whether the number of door openings exceeds the threshold.

The control unit monitors a freezing compartment door position, a duration of when the freezing compartment door is oriented in an opened position, and/or a number of times the freezing compartment door has been opened in a given time period (1150). For instance, the control unit monitors a freezing compartment door position, duration of when the freezing compartment door is oriented in an opened position, and/or a number of times the freezing compartment door has been opened in a given time period using techniques similar to those described above with respect to reference numeral 1140.

The control unit monitors an amount of time the fans have been in a single compartment configuration (1160). For example, when the control unit controls the fans to implement a single compartment configuration (e.g., only the refrigerating compartment or only the freezing compartment receives cooled air), the control unit may start a timer to measure a time that the single compartment configuration exists or the control unit may log the time when the control unit controlled the fans to implement the single compartment configuration. When the control unit uses a timer to measure a single compartment configuration time, the control unit periodically or continuously checks the timer to determine whether the fans have been oriented in a single compartment configuration more than a threshold amount of time. When the control unit logs a single compartment configuration start time, the control unit periodically or continuously compares the start time to a current time to determine whether the fans have been oriented in a single compartment configuration more than a threshold amount of time. When the control unit controls the fans to return to a dual compartment configuration, the control unit ends monitoring of the single compartment configuration, resets the monitoring data, and awaits another instance where the fans are controlled to implement a single compartment configuration.

The control unit controls fan configuration based on the current fan configuration and one or more of the monitored properties (1170). For instance, the control unit controls the fan configuration based on the monitored temperature of the refrigerating compartment, the monitored temperature of the freezing compartment, the monitored door open position of the refrigerating compartment door, the monitored door open duration of the refrigerating compartment door, the monitored number of door openings of the refrigerating compartment door, the monitored door open position of the freezing compartment door, the monitored door open duration of the freezing compartment door, the monitored number of door openings of the freezing compartment door, and/or the monitored amount of time in a single compartment configuration.

In one example, the control unit determines that the monitored temperature of the freezing compartment exceeds a threshold temperature (e.g., has increased above a range of acceptable temperatures) and that the control unit should control the fans to implement a freezing compartment only configuration to promote cooling of the freezing compartment. However, the control unit also determines that the freezing compartment door is oriented in an opened position (or has been oriented in an opened position for more than a threshold amount of time or has been opened more than a threshold number of times in the past ten minutes). To avoid sending a large amount of cool air through the opened door of the freezing compartment, the control unit determines not to control the fans to implement a freezing compartment only configuration. Instead, in this example, the control unit controls the freezing compartment fan to stop to reduce an amount of cooled air that escapes through the opened door of the freezing compartment. Accounting for the monitored door position (or other properties related to door monitoring), may improve the efficiency of the refrigerator and conserve energy.

In another example, the control unit has determined that the monitored temperature of the refrigerating compartment exceeds a threshold temperature (e.g., has increased above a range of acceptable temperatures) and has controlled the fans to implement a refrigerating compartment only configuration to promote cooling of the refrigerating compartment. After implementing the refrigerating compartment only configuration, the control unit continues to monitor the temperature of the refrigerating compartment and monitors the amount of time the fans have been oriented in the refrigerating compartment only configuration. Based on the continued monitoring, the control unit determines that the temperature of the refrigerating compartment remains above the threshold temperature and the fan configuration has been in the refrigerating compartment only configuration for more than a threshold amount of time. Based on this determination, the control unit determines that some aspect of cooling the refrigerating compartment appears to be malfunctioning. Accordingly, the control unit removes the refrigerating compartment only configuration and controls the fans to implement a dual compartment configuration or a freezing compartment only configuration.

FIG. 12 illustrates example logic 1200 for controlling the fan configuration based on the current fan configuration and one or more of the monitored properties as described above with respect to reference numeral 1170. As shown, the logic 1200 includes a current fan configuration column 1210, a temperature column 1220, a door position column 1230, a door open duration column 1240, a number of door openings column 1250, an amount of time in a single compartment configuration column 1260, and a set fan configuration column 1270. The current fan configuration column 1210 stores values for a fan state (e.g., on or off) of the freezing compartment fan and the refrigerating compartment fan. The values in the current fan configuration column 1210 are compared to detected fan configurations by the control unit.

The temperature column 1220 stores values for a temperature (e.g., within a proper operating range, below the proper operating range, or above the proper operating range) of the freezing compartment and the refrigerating compartment. The values in the temperature column 1220 are compared to monitored temperatures of the freezing and refrigerating compartments by the control unit. The door position column 1230 stores values for a door position (e.g., open or closed) of the freezing compartment door and the refrigerating compartment door. The values in the door position column 1230 are compared to monitored positions of the freezing and refrigerating compartment doors by the control unit.

The door open duration column 1240 stores values for a duration that the freezing compartment door and the refrigerating compartment door are oriented in an opened position (e.g., a particular duration or greater than/less than a limit threshold). The values in the door open duration column 1240 are compared to monitored open durations of the freezing and refrigerating compartment doors by the control unit. The number of door openings column 1250 stores values for a number of door openings (e.g., a particular number or greater than/less than a limit threshold) of the freezing compartment door and the refrigerating compartment door. The values in the number of door openings column 1250 are compared to monitored door openings of the freezing and refrigerating compartment doors by the control unit.

The amount of time in a single compartment configuration column 1260 stores values for an amount of time that the fans are in a single compartment configuration (e.g., a particular amount of time or greater than/less than a limit threshold). The values in the amount of time in a single compartment configuration column 1260 are compared to monitored single compartment configuration times by the control unit.

The set fan configuration column 1270 indicates a fan configuration setting that the control unit uses when the monitored properties match a particular row in the logic 1200. For instance, the control unit compares the monitored properties (e.g., temperature, door position, etc.) to the logic 1200 and, when the control unit finds a matching row, the control unit controls the fans to have the configuration defined in the set fan configuration column 1270 for the matching row.

Although several example rows are shown in FIG. 12, the logic 1200 may include more or fewer rows and have different configuration data or rules. In addition, the logic 1200 may include more or fewer columns of data. The logic 1200 is stored in electronic storage and accessed by the control unit in determining how to control the fans.

Referring again to FIG. 11, the control unit determines whether to provide an alert based on the current fan configuration and one or more of the monitored properties (1180). For instance, in certain circumstances, the control unit determines that a malfunction appears to have occurred or that a particular inefficiency is present. In these circumstances, the control unit provides an alert to a user to alert the user to the suspected malfunction or the particular inefficiency.

In one example, when the control unit determines that a temperature of the refrigerating compartment remains above a threshold temperature despite a fan configuration having been in the refrigerating compartment only configuration for more than a threshold amount of time, the control unit determines that a malfunction in some aspect of cooling the refrigerating compartment is likely. Based on the determination that a malfunction in some aspect of cooling the refrigerating compartment is likely, the control unit provides an alert to a user indicating that a malfunction of the refrigerating compartment is suspected. The alert may indicate that the temperature of the refrigerating compartment remained above the threshold temperature despite the fan configuration having been in the refrigerating compartment only configuration for more than the threshold amount of time.

In another example, when the control unit determines that the freezing compartment door has been oriented in an opened position for more than a threshold amount of time, the control unit provides an alert to a user indicating that inefficiency exists. The alert may indicate that the freezing compartment door has been oriented in an opened position for more than a threshold amount of time. The alert also may indicate that cooling to the freezing compartment has been stopped because the freezing compartment door has been oriented in an opened position for more than a threshold amount of time.

The alerts provided by the control unit may be visual output provided on a display (e.g., a liquid crystal display (LCD) screen) and/or audible output provided by a speaker. When the refrigerator includes a network connection, the control unit may provide an alert in an electronic communication (e.g., an electronic mail message) over a network (e.g., the Internet).

Figure 13:
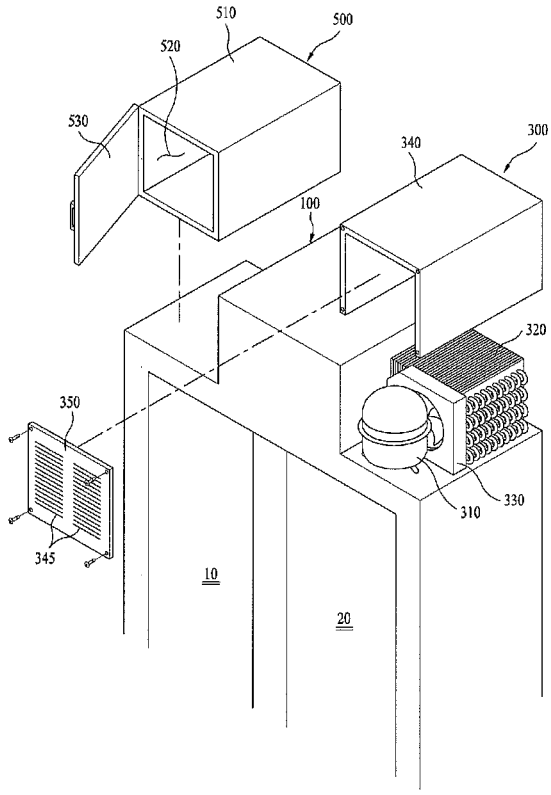
FIG. 13 is a perspective view illustrating a storage device installed in a refrigerator.

FIG. 13 illustrates a refrigerator according to another example. As shown in FIG. 13, the refrigerator is different from the above examples in which the machine compartment 300 is positioned on both sides of the cold air generating compartment 100. Specifically, in this example, the machine compartment 300 is provided on a side of the cold air generating compartment 100 and a storage device 500 is provided on the other side of the cold air generating compartment 100. The storage device 500 includes storage space 520 able to receive predetermined storing objects.

The storage device 500 includes a housing 510 defining the predetermined storage space 520 and a closable door 530 opening a front of the housing 510.

In consideration to the exterior appearance of the refrigerator, the height of the storage device 500 may be identical to the heights of the cold air generating compartment 100 and the machine compartment 300.

In other examples, instead of including the storage device 500, the refrigerator may have an extended or enlarged freezing compartment. In these examples, the freezing compartment 10 may extend into the space on the other side of the cold air generating compartment 100 shown as being occupied by the storage device 500 in FIG. 13. Accordingly, the additional space resulting from a smaller machine room may be used to increase capacity of the freezing compartment.

Figure 14:
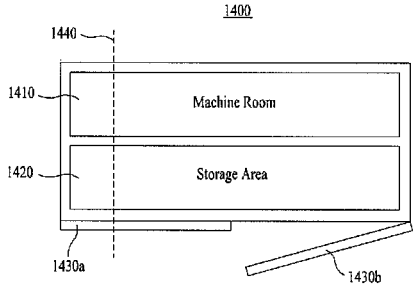
FIG. 14 is a top view illustrating an example refrigerator.

FIG. 14 illustrates an example refrigerator having a machine room that does not occupy an entire upper portion of a refrigerator body. In this example, the machine room 1410 is horizontally-partitioned in the upper portion of the refrigerator body. The machine room 1410 has been moved to a rear portion of the refrigerator body opposite of an access opening of the refrigerator and the doors of the refrigerator. Based on the positioning of the machine room 1410, additional space in the upper portion of the refrigerator body remains across a front portion of the refrigerator body. In this example, a storage area or device 1420 is positioned in the additional space that is not occupied by the machine room 1410. The storage area or device 1420 is not cooled and may be used by a user to store items, such as cookware, etc. The storage area or device 1420 is opened and closed by a pair of doors 1430*a* and 1430*b*. Although the pair of doors 1430*a* and 1430*b* are shown as being coupled to the refrigerator by hinges, the pair of doors 1430*a* and 1430*b* also may slide or being configured to tilt up and down.

Figure 15:
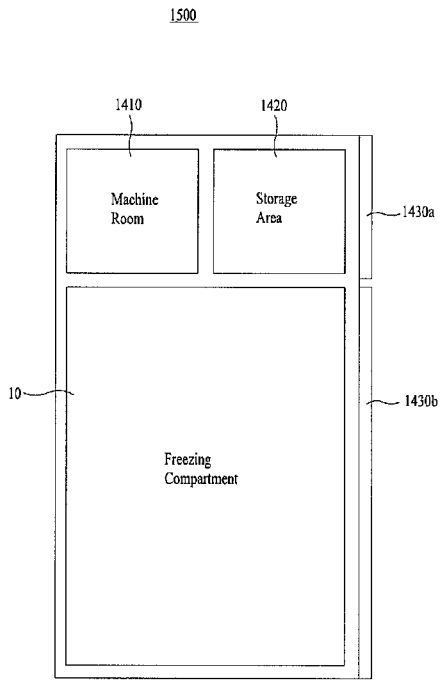
FIG. 15 is a side view illustrating a cross-section of the example refrigerator shown in FIG. 14 taken along line 1440.

FIG. 15 illustrates a cross-section of the example refrigerator shown in FIG. 14 taken along line 1440. As shown, the machine room 1410 and the storage area or device 1420 are positioned at an upper portion of the refrigerator body above the freezing compartment and are horizontally partitioned. The machine room 1410 is positioned at a rear of the upper portion of the refrigerator body and the storage area or device 1420 is positioned at a front of the upper portion of the refrigerator body.

Figure 16:
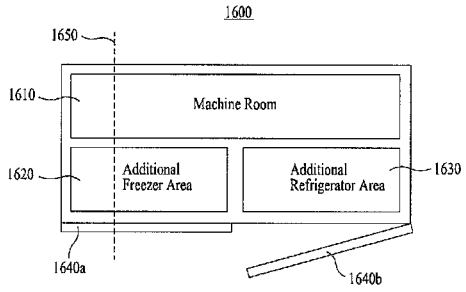
FIG. 16 is a top view illustrating an example refrigerator.

FIG. 16 illustrates another example refrigerator having a machine room that does not occupy an entire upper portion of a refrigerator body. In this example, the machine room 1610 is horizontally-partitioned in the upper portion of the refrigerator body. The machine room 1610 has been moved to a rear portion of the refrigerator body opposite of an access opening of the refrigerator and the doors of the refrigerator. Based on the positioning of the machine room 1610, additional space in the upper portion of the refrigerator body remains across a front portion of the refrigerator body. In this example, an additional freezer area 1620 and an additional refrigerating area 1630 are positioned in the additional space that is not occupied by the machine room 1610. The additional freezer area 1620 provides additional freezing compartment 10 space and the additional refrigerating area 1630 provides additional refrigerating compartment 20 space. The additional freezer area 1620 is opened and closed by a first door 1640*a* and the additional refrigerating area 1630 is opened and closed by a second door 1640*b*.

Figure 17:
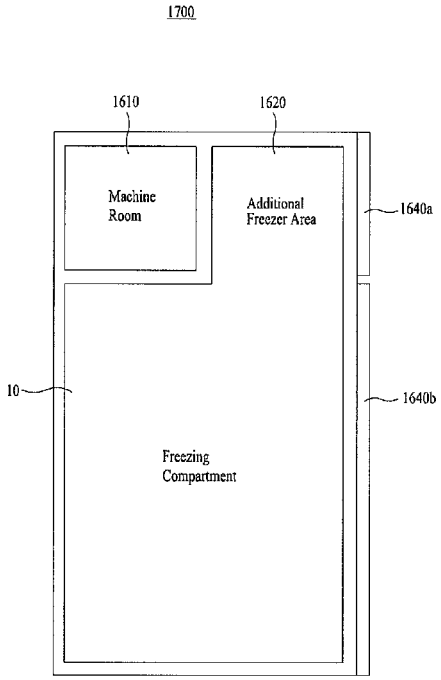
FIG. 17 is a side view illustrating an example cross-section of the example refrigerator shown in FIG. 16 taken along line 1650.

FIG. 17 illustrates a cross-section of the example refrigerator shown in FIG. 16 taken along line 1650. As shown, the machine room 1610 and the additional freezer area 1620 are positioned at an upper portion of the refrigerator body and are horizontally partitioned. The machine room 1610 is positioned at a rear of the upper portion of the refrigerator body and the additional freezer area 1620 is positioned at a front of the upper portion of the refrigerator body. The additional freezer area 1620 is an extension of the freezing compartment 10. In some implementations, an ice maker and/or an ice storage bin may be positioned in the additional freezer area 1620. As shown in FIG. 17, the door 1640*a* opens and closes only the additional freezer area 1620 and another freezing compartment door is provided.

Figure 18:
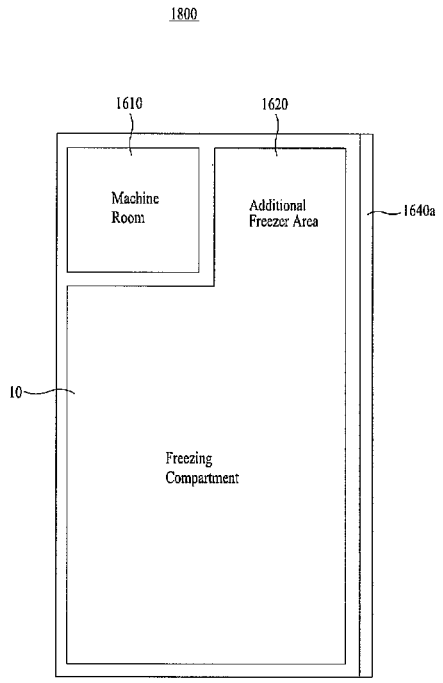
FIG. 18 is a side view illustrating another example cross-section of the example refrigerator shown in FIG. 16 taken along line 1650.

FIG. 18 illustrates another example cross-section of the example refrigerator shown in FIG. 16 taken along line 1650. In this example, the door 1640*a* opens and closes the additional freezer area 1620 and a remainder of the freezing compartment 10.

Figure 19:
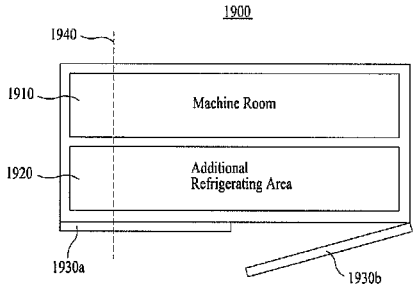
FIG. 19 is a top view illustrating an example refrigerator.

FIG. 19 illustrates an example of a bottom freezer type refrigerator having a machine room that does not occupy an entire upper portion of a refrigerator body. In this example, the machine room 1910 is horizontally-partitioned in the upper portion of the refrigerator body. The machine room 1910 has been moved to a rear portion of the refrigerator body opposite of an access opening of the refrigerator and the doors of the refrigerator. Based on the positioning of the machine room 1910, additional space in the upper portion of the refrigerator body remains across a front portion of the refrigerator body. In this example, an additional refrigerating area 1920 is positioned in the additional space that is not occupied by the machine room 1910. The additional refrigerating area 1920 provides additional refrigerating compartment space. The additional refrigerating area 1920 is opened and closed by a pair of doors 1930*a* and 1930*b*. Although the pair of doors 1930*a* and 1930*b* are shown as being coupled to the refrigerator by hinges, the pair of doors 1930*a* and 1930*b* also may slide or being configured to tilt up and down.

Figure 20:
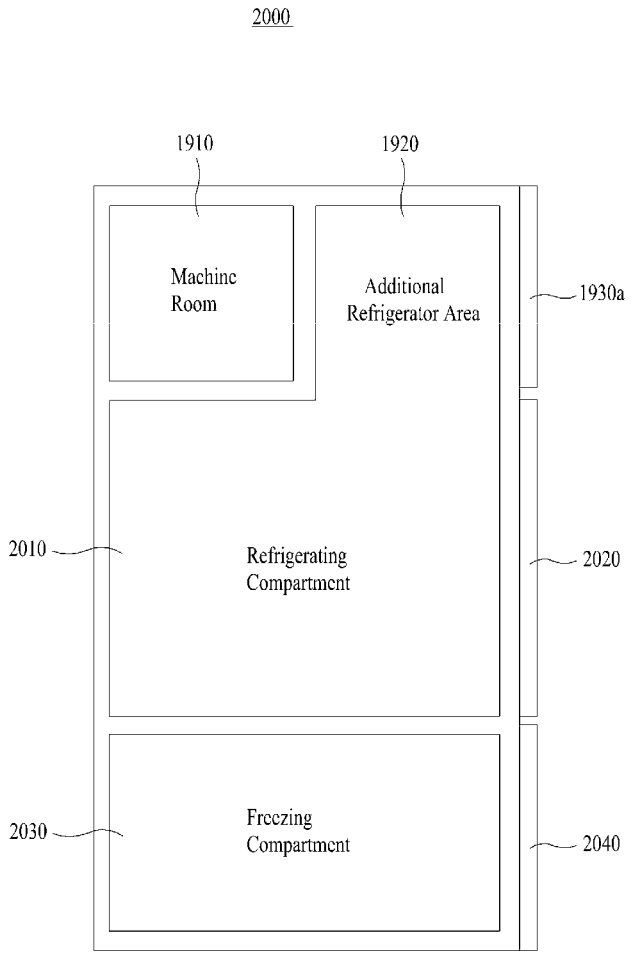
FIG. 20 is a side view illustrating an example cross-section of the example refrigerator shown in FIG. 19 taken along line 1940.

FIG. 20 illustrates a cross-section of the example refrigerator shown in FIG. 19 taken along line 1940. As shown, the machine room 1910 and the additional refrigerating area 1920 are positioned at an upper portion of the refrigerator body and are horizontally partitioned. The machine room 1910 is positioned at a rear of the upper portion of the refrigerator body and the additional refrigerating area 1920 is positioned at a front of the upper portion of the refrigerator body. The additional refrigerating area 1920 is an extension of a refrigerating compartment 2010. As shown in FIG. 20, the door 1930*a* opens and closes only the additional refrigerating area 1920 and another refrigerating compartment door 2020 is provided to open and close the remainder of the refrigerating compartment 2010.

The refrigerator also includes a freezing compartment 2030 positioned at a lower portion of the refrigerator body. The freezing compartment 2030 is opened and closed by a freezing compartment door 2040. Because the machine room 1910 is positioned at an upper portion of the refrigerator body, the refrigerator includes one or more ducts that guide air between the machine room (e.g., an evaporator in the machine room) and the freezing compartment 2030.

In some examples, an additional evaporator may be positioned in the freezing compartment 2030 (or a wall of the freezing compartment 2030). In these examples, because the machine room 1910 is positioned at an upper portion of the refrigerator body, coolant lines run between the additional evaporator and the machine room 1910.

Figure 21:
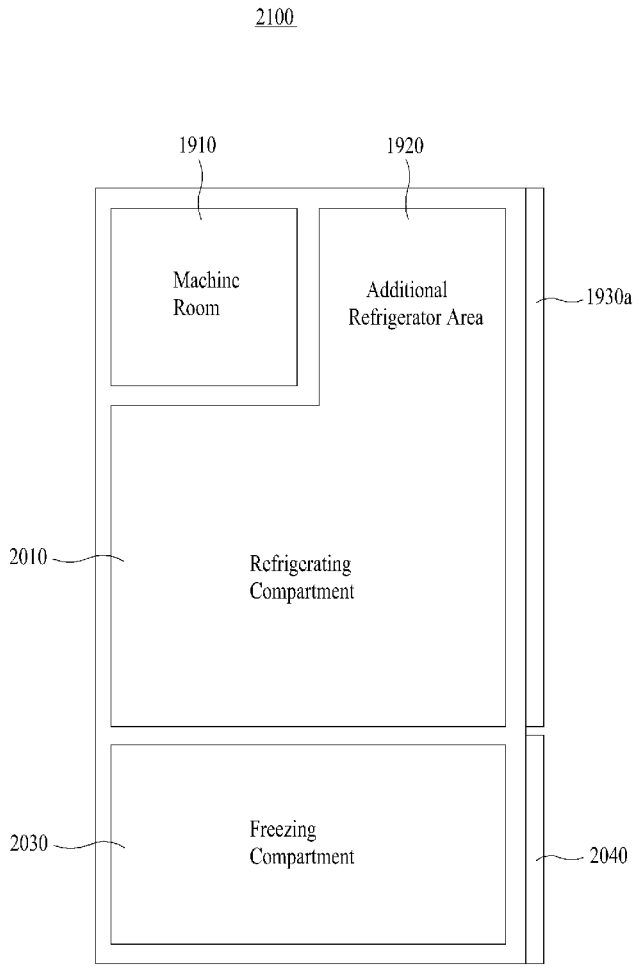
FIG. 21 is a side view illustrating another example cross-section of the example refrigerator shown in FIG. 19 taken along line 1940.

FIG. 21 illustrates another example cross-section of the example refrigerator shown in FIG. 19 taken along line 1940. In this example, the door 1930*a* opens and closes the additional refrigerating area 1920 and a remainder of the refrigerating compartment 2010.

In some implementations, if the temperature inside at least one of the plural storage compartments changes abnormally, the cold air may be supplied to the storage compartment having the abnormal temperature change quickly and intensively. As a result, the overall temperature distribution inside the entire storage compartment may be normalized substantially quickly.

Furthermore, the thickness of the refrigerator may be compact and slim to enhance the exterior appearance of the refrigerator. In addition, the indoor area occupied by the refrigerator may be reduced.

In addition, the positions of the machine and cold air generating compartments are changed to the upper portion of the body. As a result, the inner space of the storage compartment of the refrigerator may be enlarged.

In some examples, the first evaporator is separated from the second evaporator. As a result, the cold air inside the freezing and refrigerating compartments may not mixed with each other and thus the smells inside the freezing and refrigerating compartments may not be mixed with each other.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a cabinet;

a first storage compartment defined by the cabinet at a first portion of the cabinet;

a second storage compartment defined by the cabinet at a second portion of the cabinet that is different than the first portion of the cabinet;

a cold air generating compartment provided in an uppermost portion of the cabinet and connected with the first and second storage compartments, the uppermost portion of the cabinet being positioned above the first and second storage compartments when the refrigerator is oriented in an ordinary operating orientation;

a partition structure positioned in the cold air generating compartment, the partition structure dividing the cold air generating compartment into a first portion that is connected with the first storage compartment and a second portion that is connected with the second storage compartment;

a first evaporator positioned in the first portion of the cold air generating compartment and configured to generate cool air supplied to the first storage compartment;

a second evaporator positioned in the second portion of the cold air generating compartment and configured to generate cool air supplied to the second storage compartment, a machine compartment provided in the uppermost portion of the cabinet, on a first side of the cold air generating compartment, wherein a compressor and a condenser are positioned in the machine compartment, a first return duct connecting the first storage compartment with the cold air generating compartment, the first return duct guiding air of the first storage compartment into the cold air generating compartment, and a second return duct connecting the second storage compartment with the first portion of the cold air generating compartment, the second return duct guiding air of the second storage compartment into the second portion of the cold air generating compartment, wherein the first return duct is arranged along a side wall of the first storage compartment and the second return duct is arranged along a side wall of the second storage compartment.

2. The refrigerator of claim 1, further comprising:

a first cold air outlet provided between the cold air generating compartment and the first storage compartment and configured to guide cold air generated by the first evaporator in the first portion of the cold air generating compartment into the first storage compartment; and a second cold air outlet provided between the cold air generating compartment and the second storage compartment and configured to guide cold air generated by the second evaporator in the second portion of the cold air generating compartment into the second storage compartment.

3. The refrigerator of claim 2, wherein the first and second storage compartments comprise a freezing compartment and a refrigerating compartment.

4. The refrigerator of claim 3, further comprising:

a first cold air fan positioned adjacent to the first cold air outlet and configured to promote movement of cold air through the first cold air outlet; and a second cold air fan positioned adjacent to the second cold air outlet and configured to promote movement of cold air through the second cold air outlet.

5. The refrigerator of claim 4, wherein the first and second cold air fans include a cross-flow fan.

6. The refrigerator of claim 4, further comprising:

a partition wall partitioning an inner space of the cabinet into the freezing compartment and the refrigerating compartment.

7. The refrigerator of claim 6, wherein the first cold air outlet is provided adjacent to the partition wall and the first cold air fan is arranged in the first cold air outlet such that cold air discharged from the first cold air outlet moves vertically along the partition wall.

8. The refrigerator of claim 3, wherein the first portion of the cold air generating compartment comprises a first cold air generating compartment in communication with the freezing compartment, the second portion of the cold air generating compartment comprises a second cold air generating compartment in communication with the refrigerating compartment, the first evaporator is positioned in the first cold air generating compartment, and the second evaporator is positioned in the second cold air generating compartment.

9. The refrigerator of claim 8, wherein the first return duct is arranged along a side wall and an upper wall of the freezing compartment and the second return duct is arranged along a side wall and an upper wall of the refrigerating compartment.

10. The refrigerator of claim 3, wherein the freezing compartment is positioned in parallel with the refrigerating compartment and the cold air generating compartment is installed over both the freezing and refrigerating compartments.

11. The refrigerator of claim 1, further comprising:

a first water collecting tray provided under the first evaporator inside the first portion of the cold air generating compartment, the first water collecting tray being configured to collect defrost water generated by the first evaporator; and a second water collecting tray provided under the second evaporator inside the second portion of the cold air generating compartment, the second water collecting tray being configured to collect defrost water generated by the second evaporator.

12. The refrigerator of claim 11, further comprising:

a storage device provided in the uppermost portion of the cabinet, on a second side of the cold air generating compartment opposite of the first side, the storage device having an access opening that is configured to enable placement of items in and removal of items from the storage device; and at least one door configured to open and close the access opening of the storage device.

13. A refrigerator comprising:

a cabinet;

a freezing compartment defined by the cabinet at a first portion of the cabinet;

a refrigerating compartment defined by the cabinet at a second portion of the cabinet that is different than the first portion of the cabinet;

a cold air generating compartment provided in an upper portion of the cabinet and connected with the freezing and refrigerating compartments, the upper portion of the cabinet being positioned above the freezing and refrigerating compartments when the refrigerator is oriented in an ordinary operating orientation;

a partition structure positioned in the cold air generating compartment, the partition structure dividing the cold air generating compartment into a first portion that is connected with the freezing compartment and a second portion that is connected with the refrigerating compartment;

a first evaporator positioned in the first portion of the cold air generating compartment and configured to generate cool air supplied to the freezing compartment;

a second evaporator positioned in the second portion of the cold air generating compartment and configured to generate cool air supplied to the refrigerating compartment;

a first fan configured to promote movement of cold air from the first portion of the cold air generating compartment to the freezing compartment;

a second fan configured to promote movement of cold air from the second portion of the cold air generating compartment to the refrigerating compartment, a machine compartment provided in the uppermost portion of the cabinet, on a first side of the cold air generating compartment, wherein a compressor and a condenser are positioned in the machine compartment, a first return duct configured to guide cold air of the freezing compartment into the first portion of the cold air generating compartment, and a second return duct configured to guide cold air of the refrigerating compartment into the second portion of the cold air generating compartment, wherein the first return duct is arranged along a side wall of the freezing compartment and the second return duct is arranged along a side wall of the refrigerating compartment.

14. The refrigerator of claim 13, further comprising:

a first cold air outlet that enables communication of air in the first portion of the cold air generating compartment with the freezing compartment;

a second cold air outlet that enables communication of air in the second portion of the cold air generating compartment with the refrigerating compartment, wherein the partition structure is positioned between the first cold air outlet and the second cold air outlet.

15. The refrigerator of claim 14, wherein:

the first fan is positioned adjacent to the first cold air outlet and configured to promote movement of cold air of the first portion of the cold air generating compartment through the first cold air outlet and into the freezing compartment; and the second fan is positioned adjacent to the second cold air outlet and configured to promote movement of cold air of the second portion of the cold air generating compartment through the second cold air outlet and into the refrigerating compartment.

16. The refrigerator of claim 13, wherein:

the machine compartment comprises a plurality of machine compartments provided on both sides of the cold air generating compartment, wherein the condenser is installed in one of the machine compartments provided on a side of the cold air generating compartment and the compressor is installed in the other one of the machine compartments provided on the other side of the cold air generating compartment.

17. The refrigerator of claim 13, wherein:

the machine compartment is positioned above only the refrigerating compartment when the refrigerator is oriented in an ordinary operating orientation; further comprising:

a storage device provided on a second side of the cold air generating compartment, the storage device having an access opening that is configured to enable placement of items in and removal of items from the storage device; and at least one door configured to open and close the access opening of the storage device.

18. The refrigerator of claim 13, wherein both the first evaporator and the second evaporator use the compressor and the condenser in generating cool air.

* * * * *